US010507950B2

(12) United States Patent
Carrier et al.

(10) Patent No.: US 10,507,950 B2
(45) Date of Patent: Dec. 17, 2019

(54) SHIPPING INSERT

(71) Applicant: BERKLEY INTERNATIONAL, LLC

(72) Inventors: Michael Alan Carrier, Poway, CA (US); Jeff Berkley, Beverly Hills, CA (US); Joseph Martin Taber, Napa, CA (US)

(73) Assignee: Berkley International, LLC, Carson, CA (US)

( * ) Notice: Subject to any disclaimer, the term of this patent is extended or adjusted under 35 U.S.C. 154(b) by 168 days.

(21) Appl. No.: 15/724,450

(22) Filed: Oct. 4, 2017

(65) Prior Publication Data

US 2019/0100347 A1 Apr. 4, 2019

(51) Int. Cl.

| | |
|---|---|
| ***B65D 5/49*** | (2006.01) |
| ***B65D 5/50*** | (2006.01) |
| ***B65D 85/30*** | (2006.01) |
| ***B65D 81/133*** | (2006.01) |
| ***B65D 71/70*** | (2006.01) |

(52) U.S. Cl.

CPC ..... *B65D 5/48026* (2013.01); *B65D 5/5045* (2013.01); *B65D 71/70* (2013.01); *B65D 81/133* (2013.01); *B65D 85/305* (2013.01)

(58) Field of Classification Search

CPC .... B65D 85/305; B65D 25/04; B65D 5/5045; B65D 5/48026; B65D 5/49; B65D 71/70; B65D 85/30; B65D 5/50; B65D 81/133

USPC ..... 206/427, 433, 591, 594, 589, 585, 521; 220/507, 509, 510

See application file for complete search history.

(56) References Cited

U.S. PATENT DOCUMENTS

| | | | | |
|---|---|---|---|---|
| 1,367,069 | A * | 2/1921 | Mackinnon ..... | B65D 85/305 206/427 |
| 4,037,722 | A | 7/1977 | Bremer | |
| 4,131,230 | A | 12/1978 | Koehlinger et al. | |
| 4,911,300 | A * | 3/1990 | Colonna ..... | B65D 71/50 206/427 |
| 5,071,026 | A | 12/1991 | Apps | |
| 5,335,770 | A | 8/1994 | Baker et al. | |
| 5,950,829 | A | 9/1999 | Gale | |
| 6,213,297 | B1 | 4/2001 | Gale | |

(Continued)

*Primary Examiner* — Anthony D Stashick
*Assistant Examiner* — Onekki P Jolly
(74) *Attorney, Agent, or Firm* — Hankin Patent Law, APC; Kevin Schraven; Anooj Patel

(57) ABSTRACT

A shipping insert for shipping bottles, comprising: a bottom tray; a center divider; and a top tray. The bottom tray may include a plurality of base receptacles that engage with and removably hold a plurality of bottles. The center divider may include one or more supporting side extensions, one or more top center supports, and a plurality of openings. The center divider may engage and align with said bottom tray, such that said center divider is centered on said bottom tray and remains substantially in place when said plurality of bottles are loaded or unloaded into said shipping insert. The top tray may have a plurality of neck receptacles, one or more side walls, and one or more raised segments. The raised segments and side walls may have one or more shoulders. When the insert is assembled, the plurality of neck receptacles may engage bottle necks, the shoulders may engage bottle shoulders of the bottles, and the neck receptacles, are in alignment with the openings of the center divider and said base receptacles of said bottom tray.

18 Claims, 10 Drawing Sheets

(56) References Cited

U.S. PATENT DOCUMENTS

| | | | | |
|---|---|---|---|---|
| 6,290,057 | B1 | 9/2001 | Hurley | |
| 6,325,210 | B1 * | 12/2001 | Henry, Jr. | B65D 5/503 206/203 |
| 6,702,115 | B1 * | 3/2004 | Roper | B65D 5/5061 206/427 |
| 6,820,743 | B2 * | 11/2004 | Hurley | B65D 81/133 206/427 |
| 7,159,710 | B2 | 1/2007 | O'Brien et al. | |
| 7,789,239 | B2 * | 9/2010 | Juliano | B65D 5/503 206/564 |
| 8,230,997 | B1 | 7/2012 | McWilliams et al. | |
| 8,434,620 | B2 | 5/2013 | Hall | |
| 8,701,884 | B2 * | 4/2014 | Williams | B65D 81/113 206/139 |
| 8,844,718 | B2 * | 9/2014 | Hall | B65D 5/48038 206/433 |
| 10,124,924 | B2 | 11/2018 | Gilligan et al. | |
| 2007/0138047 | A1 * | 6/2007 | Berglin | B65D 81/025 206/521 |
| 2008/0302691 | A1 * | 12/2008 | Olson | B65D 5/48026 206/427 |
| 2011/0024318 | A1 | 2/2011 | Gilfert | |
| 2012/0037529 | A1 * | 2/2012 | Hall | B65D 5/48038 206/433 |
| 2013/0126384 | A1 | 5/2013 | Ogg | |
| 2015/0129447 | A1 | 5/2015 | Tremblay | |
| 2017/0050757 | A1 * | 2/2017 | Gray | B65D 5/503 |

* cited by examiner

SHIPPING INSERT

FIELD OF USE

The present disclosure relates generally to the packaging and shipping of bottles, such as glass bottles. More specifically, the present disclosure relates to a shipping insert comprised of three pieces, allowing for easy assembly within the shipping box and ensuring the secure shipment of glass wine bottles.

BACKGROUND

Packaging, shipping, or transporting glass bottles is challenging because glass is susceptible to breakage. Beyond the minimal requirement of preventing the bottles being transported from breaking during transportation, packaging systems also strive to lower the size and weight of the shipment, increase the efficiency of the assembly time, provide flexibility in the size of bottles that can be packaged, allow for a variety of bottle shapes to be shipped within the same container, and reduce costs.

Before the packaging insert of the present disclosure, packaging systems were deficient because they took too much time to assemble, did not allow for a variety of bottle shapes and sizes to be shipped within a specific box size shipping insert, did not sufficiently prevent the bottles from coming into contact with one another, and/or are bulkier and heavier than necessary.

Loose fill packing systems, such as polystyrene peanuts, may appear to provide cushioning, but can settle during transit and allow glass to touch glass or the outside of the outer box, thus contributing to damage. Other systems, such as using packing paper or Bubble Wrap®, assist in the protection of glass bottles, but can be burdensome when assembling and inefficient in maximizing shipping space. Molded shipping inserts (foam or card board), while generally effective, do not provide versatility for allowing for a variety of bottles sizes, are cumbersome to assemble, and/or are harmful to the environment due to including more packaging than is necessary.

There is, thus, a need in the art for a shipping insert that prevents glass bottles from breaking when in transit, maximizes shipping space, minimizes shipping weight (and thus harm to the environment), reduces the assembly time of the shipment, and is a cost-effective solution.

SUMMARY

To minimize the limitations in the cited references, and to minimize other limitations that will become apparent upon reading and understanding the present specification, the present specification discloses a new and improved shipping insert.

In one embodiment of the present disclosure, the bottles to be shipped can be placed into the insert system either with or without the middle insert being fitted with the bottom insert.

In a preferred embodiment, the middle insert matingly, but removably, fits with the bottom insert such that the middle insert is held in place as bottles are loaded or unloaded from the box. In this manner, the box may be efficiently and expeditiously loaded.

In another embodiment, one or more bottles can replace those bottles already within the receptacle of the bottom tray, regardless of the difference in size of bottles, thus allowing flexibility to change assembly order. The apertures of the middle insert preferably fit with wide and skinny bottles.

In a preferred embodiment, the shipping insert is made of molded wood (paper) pulp.

In another embodiment, the shipping insert is made of pre-molded polystyrene (or foam).

The present disclosure creates a very strong system that performs exceptional in drop testing.

The present disclosure allows for the use of the same shipping insert for bottles of varying heights and widths. This may be achieved because the center divider fixes the top tray in position and the bottles are independently confined in a protective cavity.

The present disclosure results in reduced costs to ship bottle because the shipping insert may be used with a variety of bottle sizes. This means that like bottles are not required to all be shipped in the same box and multiple shipping insert types do not need to be purchased by the shipper.

The present disclosure results in reduced costs, because there are less pieces to assemble, when compared to the prior art.

The present system utilizes three molded (paper) fiber components: a top tray, a center divider, and a bottom tray. All three components are placed in a corrugated shipper box when assembled. The system can be used with a wide range of bottles, and due to the construction, the user may use the same shipper box regardless of bottle height. This is achievable because the center divider fixes the top tray in position and the bottles are independently floating in a protective cavity within the shipping insert of the present disclosure.

The center divider preferably locks into the bottom tray. This improves assembly time and gives fulfillment houses the flexibility to change assembly order. By also locking the center divider into the bottom tray the users may reduce the footprint (size) of the center divider and lower materials costs. It also creates a very strong system that has exceptional performance in drop testing.

One embodiment may be a shipping insert for shipping bottles, comprising: a bottom tray; a center divider; and a top tray; wherein the bottom tray has a top surface and a bottom surface, wherein the top surface comprises a plurality of base receptacles that engage with and removably hold a plurality of bottles; wherein the plurality of base receptacles may comprise at least one of: one or more raised lips; one or more center supports; or combinations thereof; wherein the center divider may comprise a top surface and a bottom surface, wherein the top surface may comprise one or more supporting side extensions, one or more top center supports, and a plurality of openings; wherein the center divider may matingly, but removably, engage and align with the bottom tray, such that the center divider is centered on the bottom tray and remains substantially in place when the plurality of bottles are loaded or unloaded into the shipping insert; wherein the top tray comprises an inner surface and an outer surface, wherein the inner surface comprises a plurality of neck receptacles, one or more side walls, and one or more raised segments; wherein one or more side walls and the one or more raised segments comprise one or more shoulders; wherein the plurality of neck receptacles may be configured to engage a neck of the plurality of bottles and wherein the one or more shoulders may be configured to engage a shoulder of the plurality of bottles; and wherein the plurality of neck receptacles, when the insert is assembled, may be in alignment with the openings of the center divider and the base receptacles of the bottom tray. The center divider may fictionally connect with the bottom tray when the insert is assembled. The center divider may be connected to the bottom tray before the plurality of bottles are loaded into the insert. The center divider preferably remains connected to the bottom tray as the plurality of bottles are unloaded from the insert. The one or more raised lips may comprise one or more notches. The notches may frictionally connect with the supporting side extensions. The neck receptacles may be tapered. The center supports may vertically extend upward in a tapered manner, such that the plurality of bottles are cradled in place, but a user may easily slide the plurality of bottles in and out of the box when the top tray is not in place. The base receptacles may comprise one or more crumple protrusions and/or one or more crumple channels. Substantially all standard format wine bottles containing approximately 750 mL fit within and are held securely by the insert during shipping.

Another embodiment may be a shipping insert for shipping bottles, comprising: a bottom tray; a center divider; and a top tray; wherein the bottom tray may have a top surface and a bottom surface, wherein the top surface may comprise a plurality of base receptacles that may engage with and removably hold a plurality of bottles; wherein the plurality of base receptacles may comprise at least one of: one or more raised lips; one or more center supports; or combinations thereof; wherein the center divider may comprise a top surface and a bottom surface, wherein the top surface may comprises one or more supporting side extensions, one or more top center supports, and a plurality of openings; wherein the center divider may frictionally connect with the bottom tray, such that the center divider is centered on the bottom tray and remains substantially in place when the plurality of bottles are loaded or unloaded into the shipping insert; wherein the top tray may comprises an inner surface and an outer surface, wherein the inner surface may comprise a plurality of neck receptacles, one or more side walls, and one or more raised segments; wherein one or more side walls and the one or more raised segments may comprise one or more shoulders; wherein the plurality of neck receptacles are configured to engage a neck of the plurality of bottles and wherein the one or more shoulders are configured to engage a shoulder of the plurality of bottles; and wherein the plurality of neck receptacles, when the insert is assembled, may be in alignment with the openings of the center divider and the base receptacles of the bottom tray. The center divider may be connected to the bottom tray before the plurality of bottles are loaded into the insert. The center divider preferably remains connected to the bottom tray as the plurality of bottles are unloaded from the insert. The bottom tray may comprise at least two raised lips and wherein the at least two raised lips may each comprise one or more notches; wherein at least one or more of the one or more notches may frictionally connect with at least one or more of the supporting side extensions. The one or more top center supports may vertically extend upward in a tapered manner, such that the plurality of bottles are cradled in place, but a user may easily slide the plurality of bottles in and out of the box when the top tray is not in place. The base receptacles may comprise one or more crumple protrusions and/or one or more crumple channels. The neck receptacles may be tapered. Substantially all standard format wine bottles containing approximately 750 mL may fit within and may be held securely by the insert during shipping.

The shipping insert allows the user to only need one size of a shipping box to contain the shipping insert and said plurality of bottles, regardless as to whether said plurality of bottles are tall, short, or mixed.

One embodiment may be comprised of a bottom tray, a center divider, and a top tray. One or more bottles can be contained within the shipping insert. The bottom tray has receptacles in which the base of a bottle is inserted into. The bottom tray has raised lips that extend up around the perimeter and serve as a guide to lock the center divider in place. The center divider has supporting extensions that extend out in all four directions and engage with the raised lips of the bottom tray. The center divider has openings through which a bottle can be inserted into and walls extending up and angled down and out that provide support for the body of the bottle. The top tray has receptacles for the neck of a bottle, the entry of which is angled sharply inward before extending up, to serve as a cushion for the shoulder of the bottle. The top tray also has raised segments that rest on the top center supports of the center divider. The shipping insert is used within a shipping container. The bottom tray is inserted first into a shipping box, with the center divider placed on top of the bottom tray, and the top tray placed on top of the center divider.

It is an object of the present disclosure to overcome the limitations of the prior art.

Other features and advantages will become apparent to those skilled in the art from the following detailed description and its accompanying drawings.

BRIEF DESCRIPTION OF THE DRAWINGS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF ILLUSTRATIVE EMBODIMENTS

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The Figures, and their detailed descriptions, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, group of items, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, group of items, or result. In another example, substantially all of a group of items, may include all of the items of that group, or at least all of the items of that group that re generally within the normal parameters for the items. To the extent that the group of items might include members that far exceed the normal parameters, this abnormal item might not expected to be part of substantially all the group of items.

As used herein, the terms "approximately" and "about" generally refer to a deviance of within 5% of the indicated number or range of numbers. In one embodiment, the term "approximately" and "about", may refer to a deviance of between 1-10% from the indicated number or range of numbers.

Figure 1:
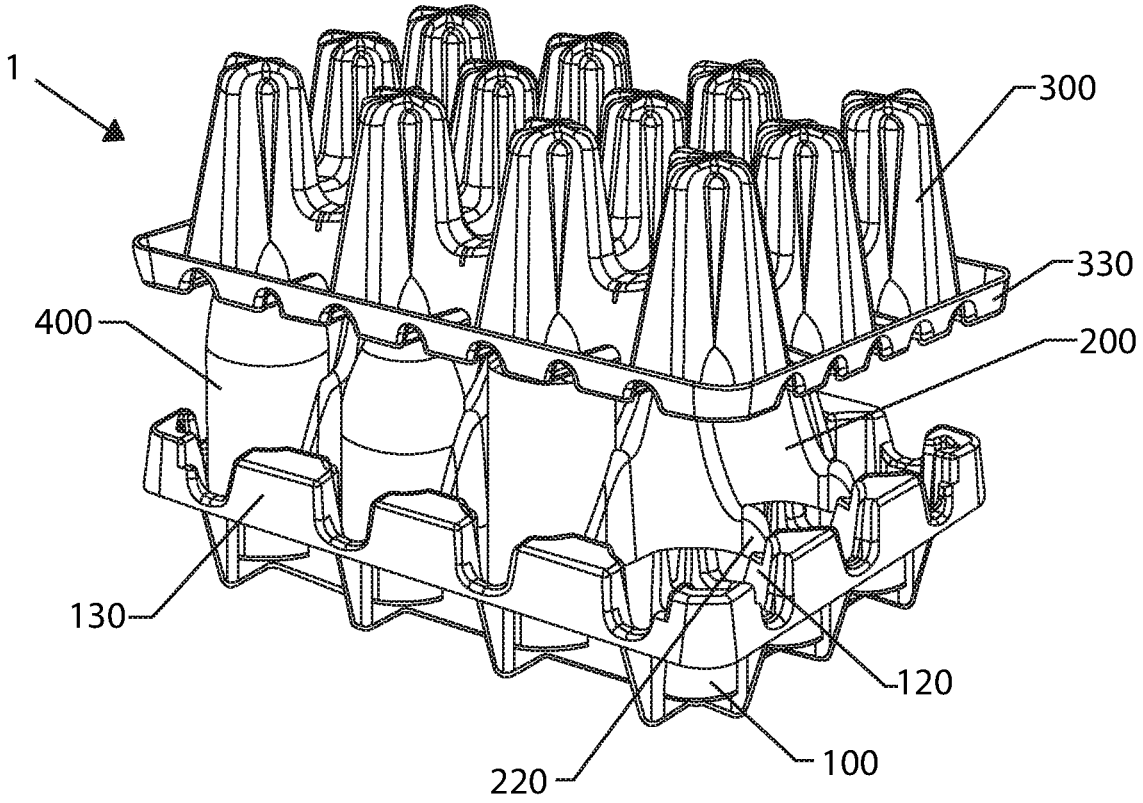
FIG. 1 is an illustration of a perspective view of one embodiment of the shipping insert.

FIG. 1 is an illustration of a perspective view of one embodiment of the shipping insert. As shown in FIG. 1, one embodiment the shipping insert 1 may comprise of a bottom tray 100, a center divider 200, and a top tray 300. As shown in FIG. 1, the shipping insert is configured to be placed within a case (12 bottles) shipping box. However, the shipping insert of the present invention may be configured to hold any number of bottle, including, but not limited to 2, 3, 4, 6, 8, 9, 10, or more than 12. Moreover, although the shipping insert is preferably sized to work with bottles holding approximately 750 mL of liquid (or other contents) or within the range of approximately 500 mL to approximately 1 L, the shipping insert may be configured to work with larger or smaller format bottles, such as approximately 1.5 L (magnums) or approximately 375 mL (half bottles). Although the insert 1 is preferably used with a corrugated cardboard shipping box, any similar shipping container may be used and may be made from any suitable material, including plastic.

The bottom tray 100 may have base receptacles 110 in into which the base of a bottle 400 may be removably inserted. The bottom tray 100 may have raised lips 120 that extend up around the perimeter and serve as a guide to lock the center divider 200 in place. The raised lips 120 (also referred to as edges) may comprise flat walls 130 on the sides that may come into contact with the shipping box, such that the insert 1 sits flush with the inside walls of a shipping box.

The center divider 200, as shown in FIG. 1, may have supporting side extensions 220 (or flanges) that may extend out from a center to the four distal edges the shipping box into which the insert 1 will be placed. The extensions 220 may preferably engage with the raised lips 120 of the bottom tray 200 such that they frictionally, but removably, engage. The center divider 200 may comprise openings 210 (shown best in FIG. 5) through which a bottle 400 may be inserted into. The center divider 200 may further comprise walls 240, which vertically extend up in a tapered manner, such that the bottles are cradled in place, but the user may easily slide the bottles in and pull them out of the box after the top tray 300 is removed. The top tray 300 may have neck receptacles 310 for the neck of a bottle 400, and may have bottom segments 340 that rest on the tops of the peak portions 230 of the center divider 200.

As shown in FIG. 1, the top tray 300 may also include side walls 330 around a perimeter, which sit flush with the inside walls of a box into which the insert 1 is placed. The shipping insert 1 is preferably used in conjunction with a shipping container. The bottom tray 100 is inserted first into an opening shipping box. Next, the center divider 200 placed on top of the bottom tray 100. The center divider is preferably placed with the support side extensions connecting and matingly engaging with the top of the bottom tray 100, such that they are frictionally engaged with each other. This frictional engagement keeps the center divider 200 from sliding or moving inadvertently while bottles are being loaded. The wine bottles may then be loaded into the box quickly and efficiently. After the wine is loaded, the top tray 300 may be placed on top of the center divider 200. The one more bottles 400 can be placed into the receptacle 110 of the bottom tray 100 either before or after the placement of the center divider 200. In another embodiment, the center divider 200 may be placed on the bottom tray 100 upside-down, which might be advantageous for certain shaped bottles, such as sparkling wine bottles or burgundy wine bottles.

Figure 2:
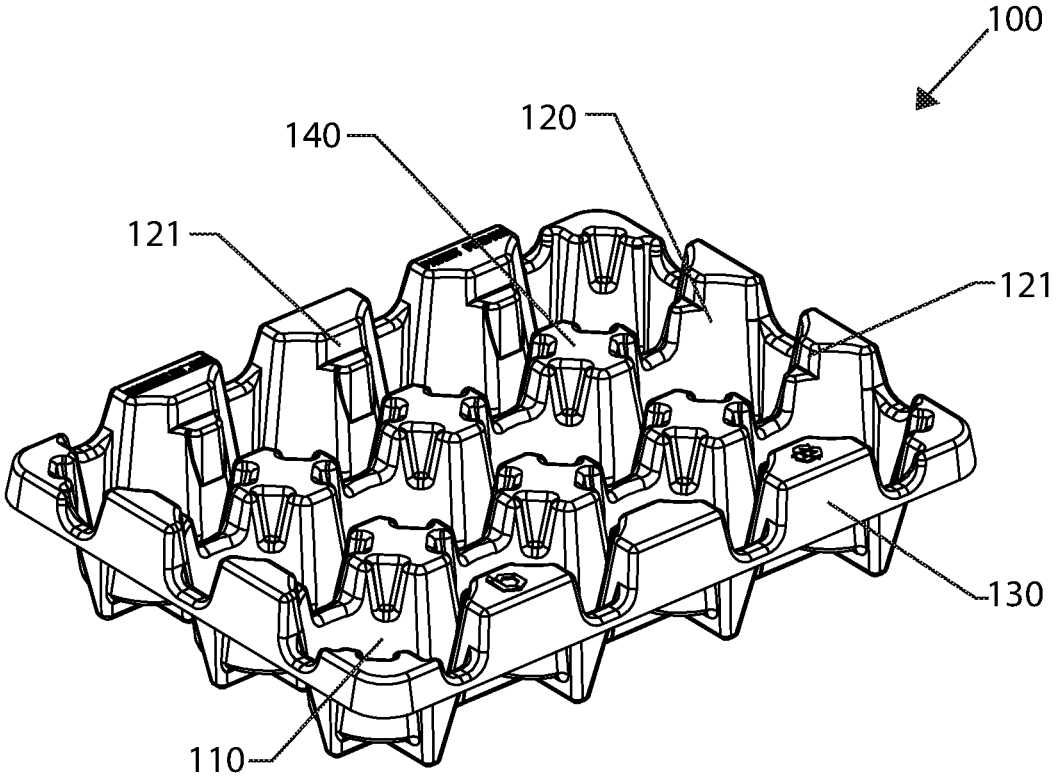
FIG. 2 is an illustration of a perspective view of the bottom tray of one embodiment of the shipping insert.

FIG. 2 is an illustration of a perspective view of the bottom tray 100 of one embodiment of the shipping insert. As shown in FIG. 2, the bottom tray 100 may be comprised of receptacles 110 wherein the base of a bottle 400 is inserted into and is cradled and/or held firmly but removably in place. The bottom tray 100 may have raised lips 120 that extend up around the perimeter and serve as a guide to lock the center divider 200 in place. The raised lips 120 have a flat wall 130 on the side facing out that is configured to sit flush with the inside walls of a box. The bottom tray 100 may also have raised center supports 140 upon which the center divider 200 is placed on. The raised lips preferably have a notch 121 that engages with the extensions 220. In other embodiments, the center divider 200 may engage with the bottom tray 100 via many other positions, such an underside of the center divider locking with the center supports 140. FIG. 2 shows that the bottom tray 100 has a top surface and a bottom or outer surface. The bottom surface is configured to engage with the interior of a shipping container, such as a shipping box.

Figure 3:
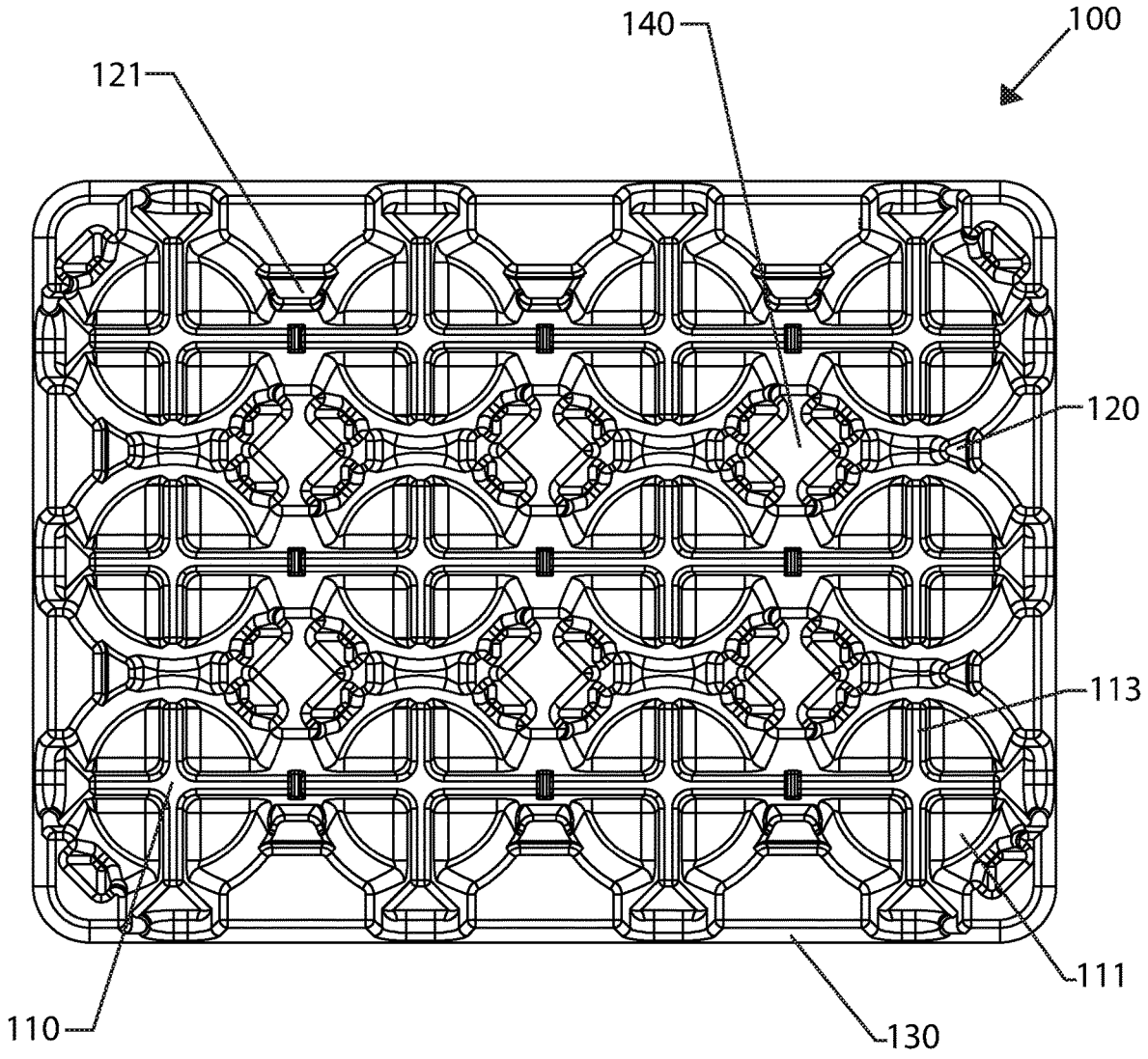
FIG. 3 is an illustration of a top view of the bottom tray of one embodiment of the shipping insert.

FIG. 3 is an illustration of a top view of the bottom tray 100 of one embodiment of the shipping insert. As shown in FIG. 3, the bottom tray 100 may be comprised of receptacles 110 wherein the base of a bottle 400 is inserted into and rests. Because most bottles are cylindrical, the receptacles 110 are preferably round. It should be understood the receptacles may be configured to be any shape, such as triangular, square, or the like. The bottom tray 100 may have raised lips 120 that extend up around the perimeter and have one or more notches 121, which may serve as a guide to lock the center divider 200 in place. The raised lips 120 have a flat wall 130 on the side facing out that is configured to sit flush with the inside walls of a box. The bottom tray 100 may also have raised center supports 140 upon which the center divider 200 is supported or engaged.

FIG. 3 also shows how the base receptacles 110 may comprise crumple protrusions 111 and crumple channels 113. The crumple protrusions 111 are show as four pie shapes, but other shapes and numbers may be used. The crumple protrusions 111 and crumple channels 113 provide a cushioning base for the bottom of the wine, allow for reduced use of material, and allow for taller or wider bottles of wine to be fit within the insert 1.

Figure 4:
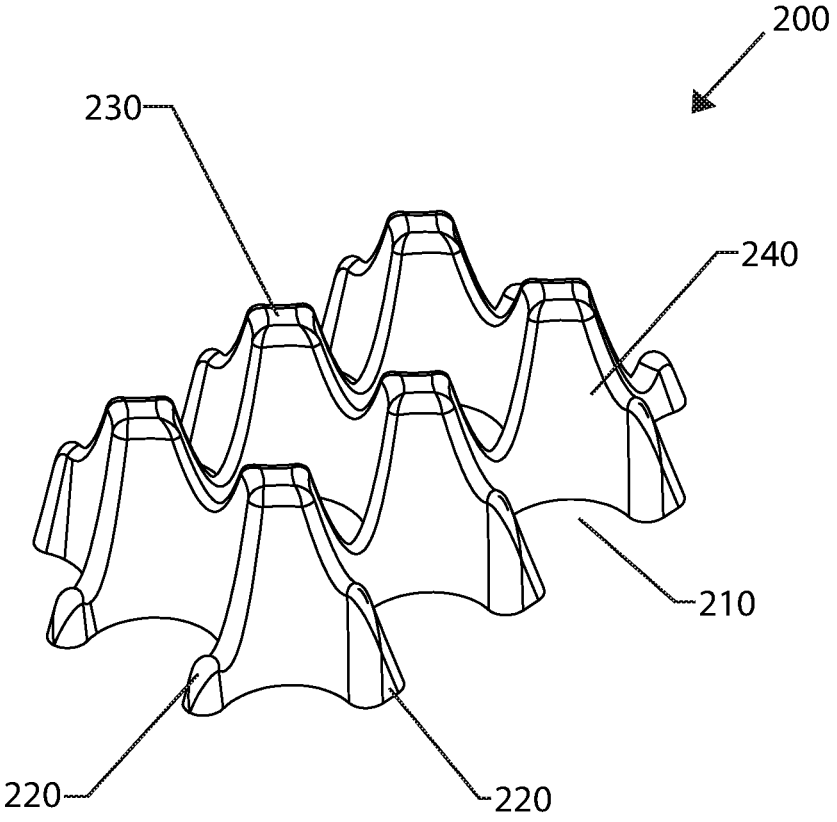
FIG. 4 is an illustration of a perspective view of the center divider of one embodiment of the shipping insert.

FIG. 4 is illustration of a perspective view of the center divider 200 of one embodiment of the shipping insert. The center divider 200 may be comprised of openings 210 through which a bottle 400 is placed through. The center divider 200 may have walls 240 extending up and angled down and out (tapered outward from top to bottom) that provide support for the body of the bottles 400 that are being shipped. The center divider 200 may also be comprised of supporting side extensions 220 that extend outward to all four sides and may engage with the notches 121 of the raised lips 120 of the bottom tray 100. The center divider, as shown, may also comprise top center supports 230 upon which the top tray 300 may rest, depending on the shape and height of the bottles.

Figure 5:
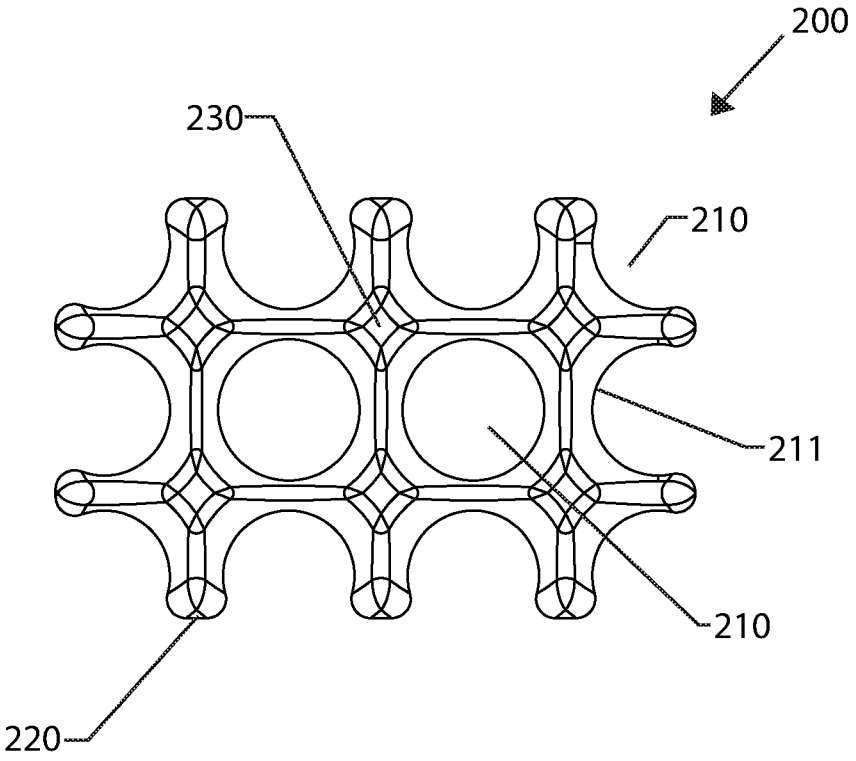
FIG. 5 is an illustration of a top view of the center divider of one embodiment of the shipping insert.

FIG. 5 is illustration of a top view of the center divider 200 of one embodiment of the shipping insert. As shown in FIG. 5, the center divider 200 may be comprised of openings 210 through which a bottle 400 is placed through. The openings, as shown, may be partially enclosed or entirely enclosed. The center divider 200 may have supporting extensions 220 that extend out towards all four sides and engage with the notches 121 of the raised lips 120 of the bottom tray 100. The openings (or apertures) 210 may have side edges 211 that may engage the side of the bottles 400 during shipping in order to prevent any two bottles from touching, and thus breaking. The openings 210 are preferably wide enough such that substantially all wine bottles that hold approximately 750 mL fit within the openings 210. This means that the diameter of the openings 210 is wider than the diameter of substantially all standard format wine bottles holding approximately 750 mL. To the extent that the opening 210 is too narrow to fit an abnormally wide bottle, the bottle may still be shipped because the center divider 200 is preferably made from pulp paper, which is crushable and may be deformed to allow shipment of the bottle. Preferably, the opening 210 has a diameter that is wide enough to allow substantially all standard format 750 mL bottles to pass through, including, Burgundy, Bordeaux, Champagne, Riesling, Cabernet, Turley®, Claret, and Pinot Noir. Preferably, the opening 210 has a diameter that is wide enough to allow substantially all odd-format 750 mL bottles to pass through, including, but not limited to, prestige (wide format of standard format bottles), port, sweet Riesling, Verdiccio, and Madeira.

Figure 6:
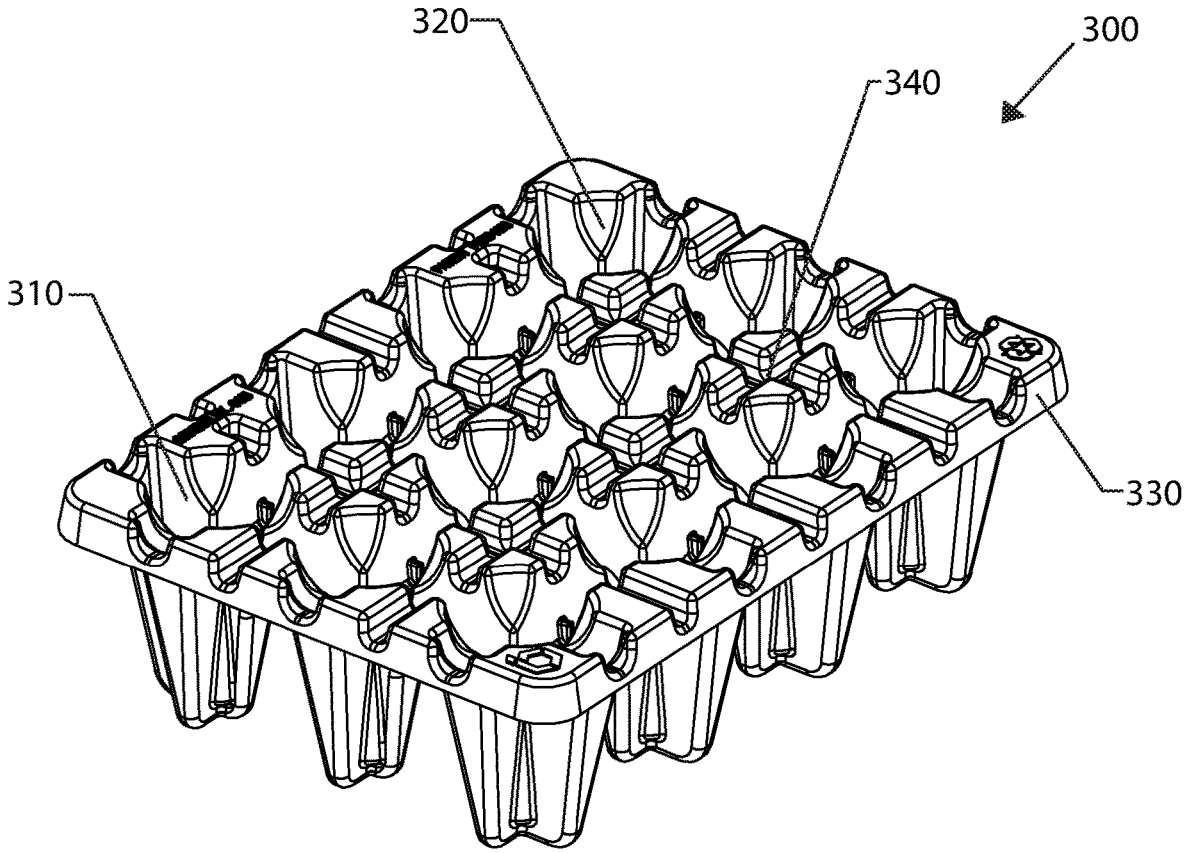
FIG. 6 is an illustration of a perspective view of the top tray of one embodiment of the shipping insert.

FIG. 6 is an illustration of a bottom perspective view of the top tray 300 of one embodiment of the shipping insert. As shown in FIG. 6, the top tray 300 may be comprised of receptacles 310, which may accommodate the neck and top of a bottle 400, wherein the entry of the receptacles 310 may be angled sharply inward at shoulders 320 before extending up, thus serving as a cushion for the shoulder of the bottles 400. The top tray 300 may also have side walls 330 around the perimeter, which may sit flush with the inside walls of a box. The top tray 300 may have raised segments 340, that allow the top tray 300 to rest on the top center supports 230 of the center divider 200. The raised segments 340 preferably have angled shoulders 320, which may engage and/or cushion the shoulder of bottles 400.

Figure 7:
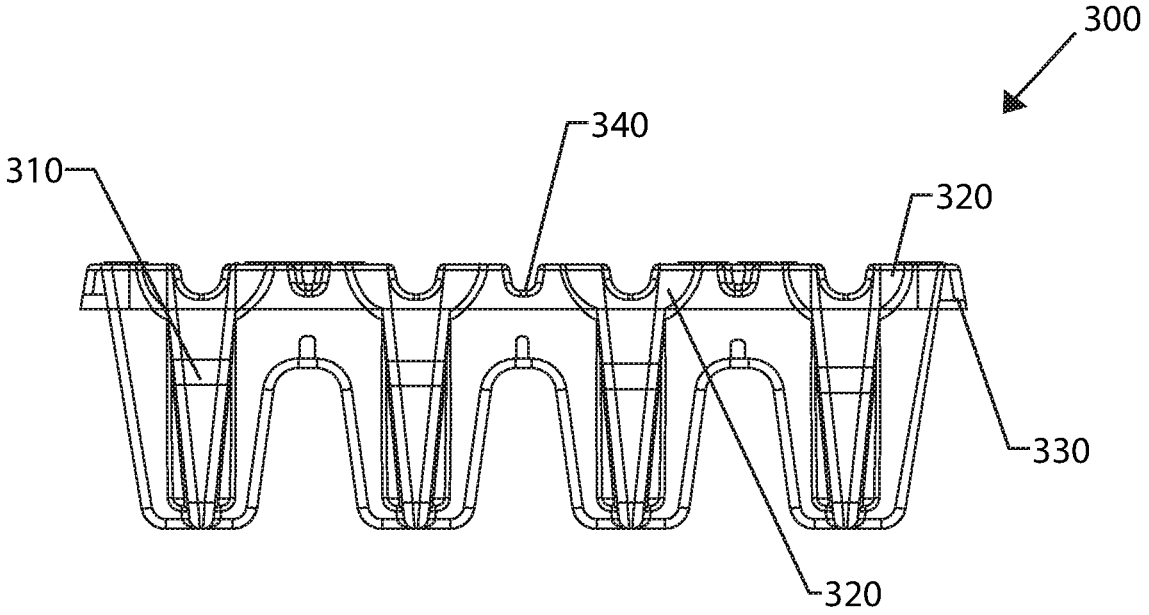
FIG. 7 an illustration of a side view of the top tray of one embodiment of the shipping insert.

FIG. 7 is an illustration of a cross-section side view of the top tray 300 of one embodiment of the shipping insert. As shown in FIG. 7, the top tray 300 may be comprised of receptacles 310 for the neck of bottles 400, wherein the entry of the receptacles 310 for the neck of a bottle is angled sharply inward at shoulder 320 before extending up in a gradually tapered manner, thus serving as a cushion for the shoulder of the bottle 400. The top tray 300 may also have side walls 330 around the perimeter, which sit flush with the inside walls of a box, and raised segments 340, that allow the top tray 300 to rest on the top center supports 230 of the center divider 200.

Figure 8:
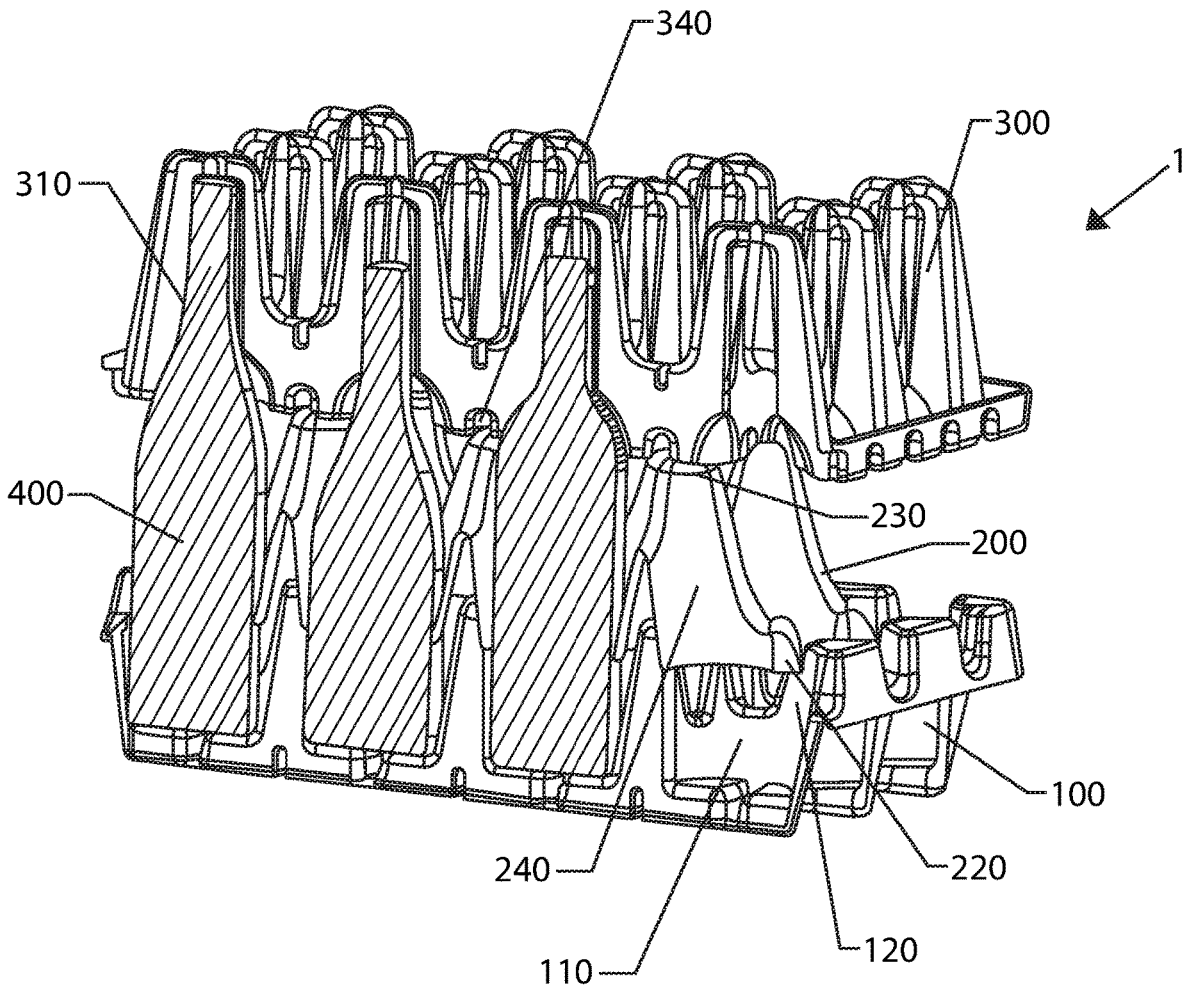
FIG. 8 is an illustration of a cross-section view of on embodiment of an assembled shipping insert.

FIG. 8 is an illustration of a cross-section view of one embodiment of the shipping insert. As shown in FIG. 8, one embodiment may comprise of a bottom tray 100, a center divider 200, and a top tray 300. One or more bottles 400 may preferably be contained within the shipping insert. The bottom tray 100 may have receptacles 110 in which the base of bottles 400 may be inserted into. The bottom tray 100 may have raised lips 120 that extend up around the perimeter and have notches that serve to lock the center divider 200 into place with the bottom tray 100. The center divider 200 may have supporting side extensions 220 that extend out to one, two, three, or, preferably, all four sides of the box, and engage with the notches 121 of the raised lips 120 of the bottom tray 200. The center divider 200 may have openings 210 through which a bottle 400 can be inserted into and walls 240 extending up and angled down and out that provide support for the body of the bottles 400. The top tray 300 may have receptacles 310 for the neck of a bottle 400, and may have raised segments 340 that rest on the top center supports 230 of the center divider 200. As shown in FIG. 8, the insert 1 may accommodate a wide variety of bottle sizes, from thin and tall to short and wide. The receptacles 310 may engage with a shorter bottle at the top of the bottle via the tapered sides. Also, the receptacles 310 may engage with a taller bottle at a top of the receptacle 310. In other embodiments, the shoulders of the bottles 400 may be engaged by the shoulders 320. Because the insert 1 is preferably made from foam or pulp paper, the insert portions are crushable and may be deformed in order to allow bottles of all shapes and sizes to be held securely in place. Indeed, as shown in FIG. 7, the insert 1 may handle different sized bottles betting part of the same shipment. It is cost effective to only have to buy one type of shipper box for many different bottle sizes.

FIG. 8 also shows how the top tray 300 may be supported by the bottles 400 and/or the center divider 200. If the bottles are tall, it is possible that the top tray 300 may not actually rest on the center divider 200. If the bottles are shorter, then the limiting element may be the center divider 200. FIG. 8 also shows that each of the parts of the insert 1 has a top surface and a bottom surface. The top surface is designed to face upward when being assembled.

Figure 9:
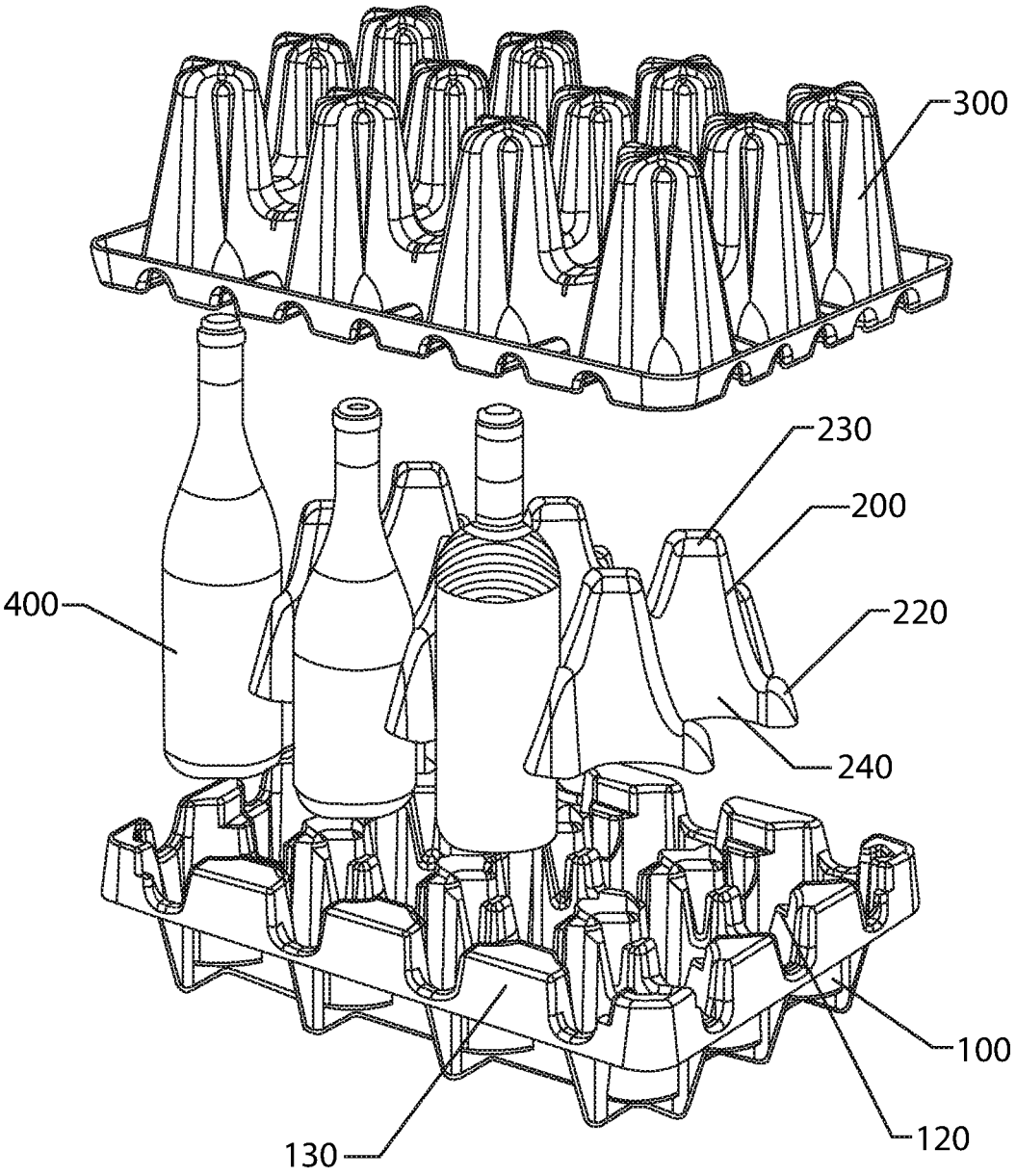
FIG. 9 is an illustration of an exploded perspective view of one embodiment of the shipping insert.

FIG. 9 is an illustration of an exploded perspective view of one embodiment of the shipping insert. As shown in FIG. 9, one embodiment may comprise of a bottom tray 100, a center divider 200, and a top tray 300. One or more bottles 400 can be contained within the shipping insert. The bottom tray 100 may have raised lips 120 that extend up around the perimeter and serve as a guide to lock the center divider 200 in place. The raised lips 120 have a flat wall 130 on the side facing out that is configured to sit flush with the inside walls of a box. The center divider 200 may have supporting side extensions 220 that extend out in all four directions and engage with the raised lips 120 of the bottom tray 200. The center divider 200 may have walls 240 extending up and angled down and out that provide support for the body of the bottle 400. The center divider 200 may also have top center supports 230 upon which the top tray 300 may rest. FIG. 9 also shows how the openings 210 of the center divider 200 are aligned with the receptacles 110 of the bottom tray 100.

Figure 10:
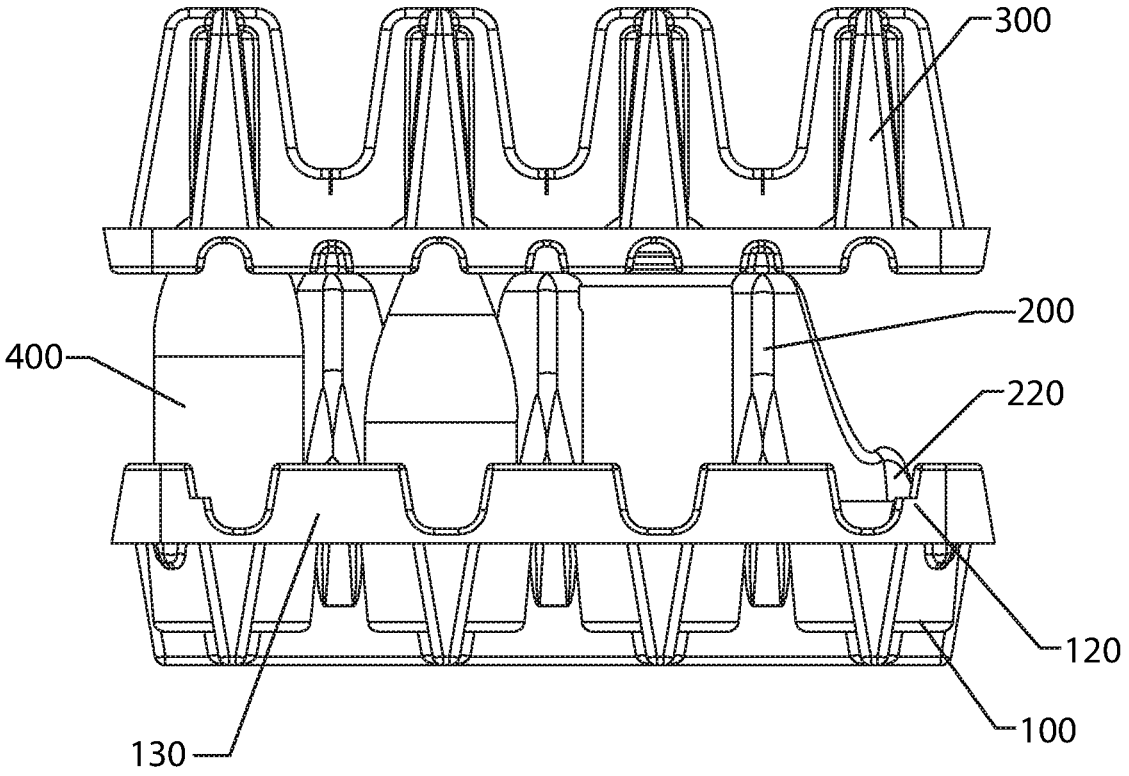
FIG. 10 is an illustration of a side view of one embodiment of an assembled shipping insert.

FIG. 10 is an illustration of a side view of one embodiment of the shipping insert. As shown in FIG. 10 one embodiment may comprise of a bottom tray 100, a center divider 200, and a top tray 300. One or more bottles 400 can be contained within the shipping insert 1. The bottom tray 100 may have raised lips 120 that extend up around the perimeter and serve as a guide to lock the center divider 200 in place. The raised lips 120 have a flat wall 130 on the side facing out that is configured to sit flush with the inside walls of a box. The center divider 200 may have supporting extensions 220 that extend out in all four directions and engage with the raised lips 120 of the bottom tray 200. FIG. 10 shows that the insert 1, when assembled and in use, protects the bottles 400 to be shipped. As shown, the bottles 400 are prevented from any side to side movement, tilting, or sliding.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A shipping insert for shipping bottles, comprising:
a bottom tray;
a center divider; and
a top tray;
wherein said bottom tray has a top surface and a bottom surface, wherein said top surface comprises a plurality of base receptacles that engage with and removably hold a plurality of bottles;
wherein said plurality of base receptacles comprise at least one of: one or more raised lips; one or more center supports; or combinations thereof;
wherein said center divider comprises a top surface and a bottom surface, wherein said top surface comprises one or more supporting side extensions, one or more top center supports, and a plurality of openings;
wherein said center divider matingly, but removably, engages and aligns with said bottom tray, such that said center divider is centered on said bottom tray and remains substantially in place when said plurality of bottles are loaded or unloaded into said shipping insert;
wherein said top tray comprises an inner surface and an outer surface, wherein said inner surface comprises a plurality of neck receptacles, one or more side walls, and one or more raised segments;
wherein one or more side walls and said one or more raised segments comprise one or more shoulders;
wherein said plurality of neck receptacles are configured to engage a neck of said plurality of bottles and wherein said one or more shoulders are configured to engage a shoulder of said plurality of bottles;
wherein said plurality of neck receptacles, when said shipping insert is assembled, are in alignment with said openings of said center divider and said base receptacles of said bottom tray;
wherein said one or more raised lips comprise one or more notches; and
wherein at least one or more of said one or more notches frictionally connect with at least one or more of said supporting side extensions.

2. The shipping insert of claim 1, wherein said center divider fictionally connects with said bottom tray when said shipping insert is assembled.

3. The shipping insert of claim 2, wherein said center divider is connected to said bottom tray before said plurality of bottles are loaded into said shipping insert.

4. The shipping insert of claim 3, wherein said center divider remains connected to said bottom tray as said plurality of bottles are unloaded from said shipping insert.

5. The shipping insert of claim 1, wherein said neck receptacles are tapered.

6. The shipping insert of claim 1, wherein said one or more top center supports vertically extend upward and are tapered, such that the plurality of bottles are cradled in place, but a user may slide the plurality of bottles in and out of said shipping insert when said top tray is not in place.

7. The shipping insert of claim 1, wherein said base receptacles comprise one or more crumple protrusions.

8. The shipping insert of claim 7, wherein said base receptacles comprise one or more crumple channels.

9. The shipping insert of claim 1, wherein only one size of a shipping box is needed to contain said shipping insert and said plurality of bottles, regardless as to whether said plurality of bottles are tall, short, or mixed.

10. A shipping insert for shipping bottles, comprising:
a bottom tray;
a center divider; and
a top tray;
wherein said bottom tray has a top surface and a bottom surface, wherein said top surface comprises a plurality of base receptacles that engage with and removably hold a plurality of bottles;
wherein said plurality of base receptacles comprise at least one of: one or more raised lips; one or more center supports; or combinations thereof;

wherein said center divider comprises a top surface and a bottom surface, wherein said top surface comprises one or more supporting side extensions, one or more top center supports, and a plurality of openings;

wherein said center divider frictionally connects with said bottom tray, such that said center divider is centered on said bottom tray and remains substantially in place when said plurality of bottles are loaded or unloaded into said shipping insert;

wherein said top tray comprises an inner surface and an outer surface, wherein said inner surface comprises a plurality of neck receptacles, one or more side walls, and one or more raised segments;

wherein one or more side walls and said one or more raised segments comprise one or more shoulders;

wherein said plurality of neck receptacles are configured to engage a neck of said plurality of bottles and wherein said one or more shoulders are configured to engage a shoulder of said plurality of bottles;

wherein said plurality of neck receptacles, when said shipping insert is assembled, are in alignment with said openings of said center divider and said base receptacles of said bottom tray;

wherein only one size of a shipping box is needed to contain said shipping insert and said plurality of bottles, regardless as to whether said plurality of bottles are tall, short, or mixed;

wherein said bottom tray comprises at least two raised lips and wherein said at least two raised lips of said bottom tray each comprise one or more notches; and wherein at least one or more of said one or more notches frictionally connect with at least one or more of said supporting side extensions.

11. The shipping insert of claim 10, wherein said center divider is connected to said bottom tray before said plurality of bottles are loaded into said shipping insert.

12. The shipping insert of claim 11, wherein said center divider remains connected to said bottom tray as said plurality of bottles are unloaded from said shipping insert.

13. The shipping insert of claim 12, wherein said one or more top center supports vertically extend upward and are tapered, such that the plurality of bottles are cradled in place, but a user may slide the plurality of bottles in and out of said box when said top tray is not in place.

14. The shipping insert of claim 13, wherein said base receptacles comprise one or more crumple protrusions.

15. The shipping insert of claim 14, wherein said neck receptacles are tapered.

16. The shipping insert of claim 15, wherein said base receptacles comprise one or more crumple channels.

17. The shipping insert of claim 16, wherein substantially all standard format wine bottles containing approximately 750 mL fit within and are held securely by said shipping insert during shipping.

18. A shipping insert for shipping bottles, comprising:

a bottom tray;

a center divider; and a top tray;

wherein said bottom tray has a top surface and a bottom surface, wherein said top surface comprises a plurality of base receptacles that engage with and removably hold a plurality of bottles;

wherein said plurality of base receptacles comprise one or more raised lips and one or more center supports;

wherein said one or more raised lips comprise one or more notches;

wherein said center divider comprises a top surface and a bottom surface, wherein said top surface comprises one or more supporting side extensions, one or more top center supports, and a plurality of openings;

wherein at least one or more of said one or more notches frictionally connect with at least one or more of said supporting side extensions, such that said center divider matingly, but removably, engages with said bottom tray, such that said center divider is centered on said bottom tray and remains substantially in place when said plurality of bottles are loaded or unloaded into said shipping insert;

wherein said top tray comprises an inner surface and an outer surface, wherein said inner surface comprises a plurality of neck receptacles, one or more side walls, and one or more raised segments;

wherein one or more side walls and said one or more raised segments comprise one or more shoulders;

wherein said plurality of neck receptacles are configured to engage a neck of said plurality of bottles and wherein said one or more shoulders are configured to engage a shoulder of said plurality of bottles;

wherein said plurality of neck receptacles, when said shipping insert is assembled, are in alignment with said openings of said center divider and said base receptacles of said bottom tray;

wherein said center divider remains connected to said bottom tray as said plurality of bottles are unloaded from said shipping insert;

wherein substantially all standard format wine bottles containing approximately 750 mL fit within and are held securely by said shipping insert during shipping; and wherein only one size of a shipping box is needed to contain said shipping insert and said plurality of bottles, regardless as to whether said plurality of bottles are tall, short, or mixed.

* * * * *